US007714789B2

(12) United States Patent
Tsai et al.

(10) Patent No.: US 7,714,789 B2
(45) Date of Patent: May 11, 2010

(54) ANTENNA HAVING A DIVERSITY EFFECT

(75) Inventors: Tiao-Hsing Tsai, Taipei Shien (TW); Chih-Wei Liao, Yilan Shien (TW); Chao-Hsu Wu, Tao Yuan Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 66 days.

(21) Appl. No.: 12/197,885

(22) Filed: Aug. 25, 2008

(65) Prior Publication Data

US 2009/0256754 A1 Oct. 15, 2009

(30) Foreign Application Priority Data

Apr. 10, 2008 (TW) ..... 97112992 A

(51) Int. Cl.
*H01Q 1/24* (2006.01)

(52) U.S. Cl. ..... 343/702

(58) Field of Classification Search ..... 343/700 MS, 343/702, 893, 895, 818

See application file for complete search history.

(56) References Cited

U.S. PATENT DOCUMENTS

| | | | | |
|---|---|---|---|---|
| 5,966,097 | A * | 10/1999 | Fukasawa et al. | 343/700 MS |
| 6,891,506 | B2 * | 5/2005 | Jarmuszewski et al. | 343/702 |
| 6,980,154 | B2 * | 12/2005 | Vance et al. | 343/700 MS |
| 7,183,984 | B2 * | 2/2007 | Jarmuszewski et al. | 343/702 |
| 7,400,300 | B2 * | 7/2008 | Qi et al. | 343/700 MS |

* cited by examiner

*Primary Examiner*—Huedung Mancuso
(74) *Attorney, Agent, or Firm*—Stephen A. Bent; Foley & Lardner LLP

(57) ABSTRACT

An antenna includes a dielectric substrate, a grounding plane, first and second grounding elements, and first and second radiating elements. The grounding plane is formed on the dielectric substrate and is disposed between the first and second radiating elements. The first and second grounding elements extend from the grounding plane away from each other. The first and second radiating elements are coupled electromagnetically to the first and second grounding elements, respectively.

20 Claims, 18 Drawing Sheets efficiency = -2.6 dB, gain =3.2 dBi @ (150, 70)

H plane (X-Y plane , $\theta = 90$)

Peak = -1.6 dBi, Avg. = -3.98 dBi.

E1 plane (X-Z plane, Ø = 0)

Peak = 2.17 dBi, Avg. = -1.37 dBi.

E2 plane (Y-Z plane, Ø = 90)

Peak =2.51 dBi, Avg. = -2.19 dBi.

efficiency = -2.13 dB, gain =5 dBi @ (150, 70)

H plane (X-Y plane , $\theta = 90$)

Peak = -0.74 dBi, Avg. = -3.44 dBi.

E1 plane (X-Z plane, Ø = 0)

Peak = 2.94 dBi, Avg. = -1.21 dBi.

E2 plane (Y-Z plane, Ø = 90)

Peak =3.96 dBi, Avg. = -1.73 dBi.

efficiency = -2.1 dB, gain =3.8 dBi @ (165, 280)

H plane (X-Y plane , $\theta = 90$)

Peak = -2.67 dBi, Avg. = -4.78 dBi.

E1 plane (X-Z plane, Ø = 0)

Peak = 2.94 dBi, Avg. = -0.91 dBi.

E2 plane (Y-Z plane, Ø = 90)

Peak =3.4 dBi, Avg. = -1.9 dBi.

efficiency = -1.83 dB, gain =4.41 dBi @ (150, 220)

H plane (X-Y plane , $\theta = 90$)

Peak = -1.42 dBi, Avg. = -3.35 dBi.

E1 plane (X-Z plane, Ø = 0)

Peak = 3.58 dBi, Avg. = -0.55 dBi.

E2 plane (Y-Z plane, Ø = 90)

Peak =4.12 dBi, Avg. = -1.37 dBi.

efficiency = -2.23 dB, gain =5.38 dBi @ (150, 250)

H plane (X-Y plane , $\theta = 90$)

Peak = -1.41 dBi, Avg. = -3.48 dBi.

E1 plane (X-Z plane, $\emptyset = 0$)

Peak = 3.85 dBi, Avg. = -1.25 dBi.

E2 plane (Y-Z plane, $\emptyset = 90$)

Peak =4.96 dBi, Avg. = -1.68 dBi.

efficiency = -1.25dB, gain =5.22 dBi @ (165, 90)

efficiency = -1.25dB, gain =5.25 dBi @ (165, 300)

efficiency = -0.16 dB, gain =5.18 dBi @ (165, 255)

ρ Omni=0

ρ Directional=0.15 @ Ø efficiency = -1.42dB, gain =5.05 dBi @ (150, 50)

efficiency = -1.06dB, gain =6.11 dBi @ (150, 280)

efficiency = 0.16 dB, gain =6.57 dBi @ (180, 150)

ρOmni=0.01

ρDirectional=0.2 @ Ø efficiency = -1.25 dB, gain =5.22 dBi @ (165, 90)

H plane (X-Y plane , $\theta = 90$)

Peak = -2.97 dBi, Null = -14.01dBi, Avg. = -5.34 dBi.

E1 plane (X-Z plane, Ø = 0)

Peak = 3.93 dBi, Null = -5.14dBi, Avg. = 0.33 dBi.

E2 plane (Y-Z plane, Ø = 90)

Peak =5.22 dBi, Null = -16.83dBi, Avg. = -1.34 dBi.

efficiency = -1.42 dB, gain =5.05 dBi @ (150, 50)

H plane (X-Y plane , $\theta = 90$)

Peak = 0.82 dBi, Null = -4.09dBi, Avg. = -1.78 dBi.

E1 plane (X-Z plane, Ø = 0)

Peak = 4.76 dBi, Null = -8.17dBi , Avg. = -0.05 dBi.

E2 plane (Y-Z plane, Ø = 90 )

Peak =4.76 dBi, Null = -12.55dBi, Avg. = -0.9 dBi.

efficiency = -1.25 dB, gain =5.25 dBi @ (165, 300)

H plane (X-Y plane , $\theta = 90$)

Peak = -2.57 dBi, Null = -16.56dBi, Avg. = -4.65 dBi.

E1 plane (X-Z plane, $\emptyset = 0$)

Peak = 4.19 dBi, Null = -4.93dBi, Avg. = 0.15 dBi.

E2 plane (Y-Z plane, $\emptyset = 90$)

Peak =5.11 dBi, Null = -19.36dBi, Avg. = -1.12 dBi.

ANTENNA HAVING A DIVERSITY EFFECT

CROSS-REFERENCE TO RELATED APPLICATION

This application claims priority of Taiwanese application no. 097112992, filed on Apr. 10, 2008.

BACKGROUND OF THE INVENTION

1. Field of the Invention

This invention relates to an antenna, more particularly to an antenna that is applicable to worldwide interoperability for microwave access (WiMAX) technology.

2. Description of the Related Art

Worldwide interoperability for microwave access (WiMAX) technology is undergoing rapid development. However, since WiMAX technology supports a transmission range of up to 50 kilometers, WiMAX technology is susceptible to multipath interference, especially in an urban setting where there is a large number of buildings.

Therefore, there exists a need for an antenna that is applicable to WiMAX technology and that minimizes, if not eliminates, the above-described problem.

SUMMARY OF THE INVENTION

According to the present invention, an antenna comprises a dielectric substrate, a grounding plane, first and second grounding elements, first and second radiating elements, and first and second feeding points. The grounding plane is formed on the dielectric substrate and has a connecting end. The first and second grounding elements extend from the connecting end of the grounding plane away from each other. The first and second radiating elements are spaced apart from each other. The connecting end of the grounding plane is disposed between the first and second radiating elements. The first radiating element is spaced apart from and coupled electromagnetically to the first grounding element, thereby permitting operation of the first grounding element and the first radiating element in a frequency range. The second radiating element is spaced apart from and coupled electromagnetically to the second grounding element, thereby permitting operation of the second grounding element and the second radiating element in the frequency range. Each of the first and second feeding points is formed on the dielectric substrate and is coupled to a respective one of the first and second radiating elements.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
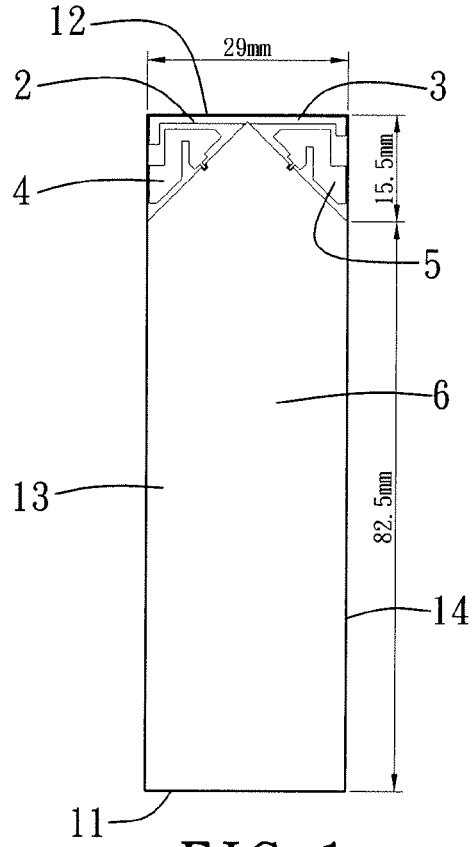
FIG. 1 is a schematic view of the first preferred embodiment of an antenna according to this invention.

Before the present invention is described in greater detail, it should be noted that like elements are denoted by the same reference numerals throughout the disclosure.

Figure 2:
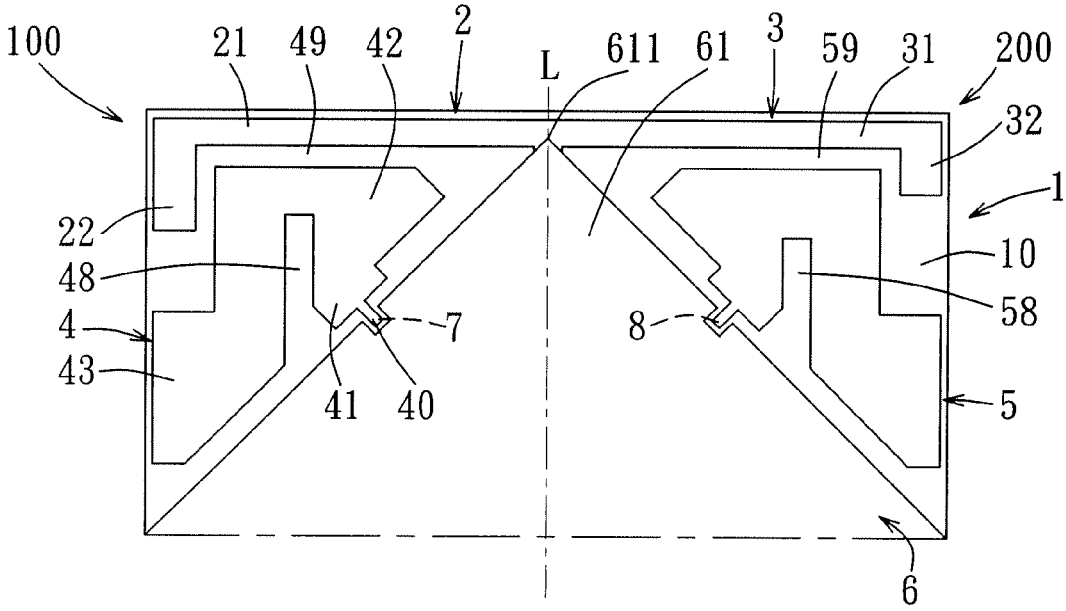
FIG. 2 is a schematic view illustrating a connecting end of a grounding plane, first and second grounding elements, and first and second radiating elements of the first preferred embodiment.

Referring to FIGS. 1 and 2, the first preferred embodiment of an antenna according to this invention is shown to include a dielectric substrate 1, a grounding plane 6, first and second antenna units 100, 200, and first and second feeding points 7, 8.

The antenna of this invention is applicable to a card (not shown), such as an Express Card or a wireless network card, and is operable in a first operating range from 3300 MHz to 3800 MHz.

The dielectric substrate 1 is generally rectangular in shape, has a surface 10, and includes opposite first and second edges 11, 12, and opposite third and fourth edges 13, 14 that interconnect the first and second edges 11, 12. In this embodiment, the dielectric substrate 1 has a length of 98 millimeters and a width of 29 millimeters.

The grounding plane 6 is formed on the surface 10 of the dielectric substrate 1, extends from the first edge 11 toward the second edge 12 of the dielectric substrate 1, and has a connecting end 61 that is distal from the first edge 11 of the dielectric substrate 1, that is tapered, and that has a tip.

The first antenna unit 100 includes a first grounding element 2 and a first radiating element 4.

The second antenna unit 200 includes a second grounding element 3 and a second radiating element 5.

Each of the first and second radiating elements 4, 5 is spaced apart from and electromagnetically coupled to a respective one of the first and second grounding elements 2, 3, thereby permitting operation of each of the first and second antenna units 100, 200 in the first frequency range, in a manner that will be described hereinafter.

The first grounding element 2 is formed on the surface 10 of the dielectric substrate 1, is generally L-shaped, and includes first and second segments 21, 22. The first segment 21 of the first grounding element 2 extends from the tip of the connecting end 61 of the grounding plane 6 toward the third edge 13 of the dielectric substrate 1 and is substantially parallel to the second edge 12 of the dielectric substrate 1. The second segment 22 of the first grounding element 2 extends transversely from the first segment 21 of the first grounding element 2 and is substantially parallel to the third edge 13 of the dielectric substrate 1. In this embodiment, the first grounding element 2 has a length of one-quarter wavelength in the first frequency range.

The first radiating element 4 is formed on the surface 10 of the dielectric substrate 1, is disposed between the connecting end 61 of the grounding plane 6 and the first grounding element 2, and includes a feeding segment 40, and first, second, and third segments 41, 42, 43. The feeding segment 40 of the first radiating element 4 has opposite first and second ends. The first segment 41 of the first radiating element 4 extends from the feeding segment 40 of the first radiating element 4, and has a first end connected to the second end of the feeding segment 40 of the first radiating element 4, and a second end opposite to the first end thereof. The second segment 42 of the first radiating element 4 extends from the first segment 41 of the first radiating element 4, is disposed adjacent and substantially parallel to the first segment 21 of the first grounding element 2, and has a first end connected to the second end of the first segment 41 of the first radiating element 4, and a second end opposite to the first end thereof. The third segment 43 of the first radiating element 4 extends from the second segment 42 of the first radiating element 4 and has an end connected to the second end of the second segment 42 of the first radiating element 4. In this embodiment, the first, second, and third segments 41, 42, 43 of the first radiating element 4 cooperatively define an elongated slot 48 thereamong. Moreover, in this embodiment, the first radiating element 4 has a length of one-quarter wavelength in the first frequency range. Further, in this embodiment, the second segment 42 of the first radiating element 4 has a length of less than one-eighth wavelength in the first frequency range. In addition, the third segment 43 of the first radiating element 4 has a generally axe-shaped.

The second grounding element 3 is formed on the surface 10 of the dielectric substrate 1, is generally L-shaped, and includes first and second segments 31, 32. The first segment 31 of the second grounding element 3 extends from the tip of the connecting end 61 of the grounding plane 6 toward the fourth edge 14 of the dielectric substrate 1 and is substantially parallel to the second edge 12 of the dielectric substrate 1. The second segment 32 of the second grounding element 3 extends transversely from the first segment 31 of the second grounding element 3 and is substantially parallel to the fourth edge 14 of the dielectric substrate 1.

In this embodiment, the first and second grounding elements 2, 3 are partially symmetrical with respect to an axis of symmetry (L). In particular, while the first segments 21, 31 of the first and second grounding elements 2, 3 have shape and size that are identical, the second segment 32 of the second grounding element 3 has a length shorter than that of the second segment 22 of the first grounding element 2.

The second radiating element 5 is formed on the surface 10 of the dielectric substrate 1, is spaced apart from the first radiating element 4, and is disposed between the connecting end 61 of the grounding plane 6 and the second grounding element 3.

In this embodiment, the first and second radiating elements 4, 5 are partially symmetrical with respect to the axis of symmetry (L). In particular, the second radiating element 5, like the first radiating element 4, includes first, second, and third segments that cooperatively define a slot 58 thereamong. The second segment of the second radiating element 5 has a width narrower than that of the second segment 42 of the first radiating element 4. As such, the slot 58 in the second radiating element 5 is smaller than the slot 48 in the first radiating element 4.

Figure 4:
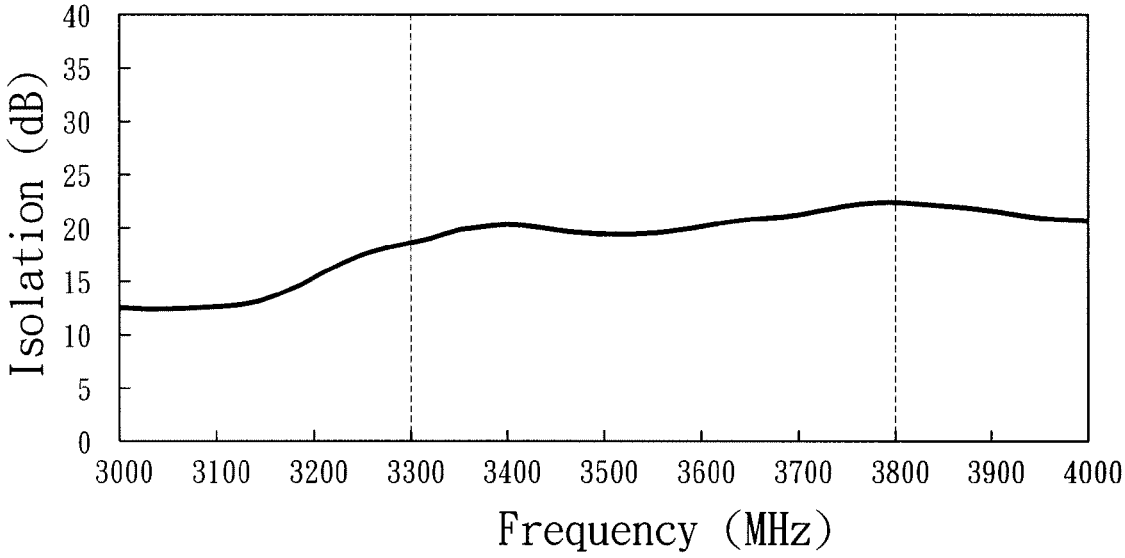
FIG. 4 shows a plot illustrating an isolation of the first preferred embodiment.

It is noted that since the connecting end 61 of the grounding plane 6 is disposed between the first and second radiating elements 4, 5, the antenna of this invention has a high isolation. Moreover, since the first and second grounding elements 2, 3 are partially symmetrical and since the first and second radiating elements 4, 5 are partially symmetrical, the first antenna unit 100 resonates at a first resonance frequency, and the second antenna unit 200 resonates at a second resonance frequency different from the first resonance frequency. This results in substantially constant isolation values for the antenna of this invention in the first frequency range, as shown in FIG. 4.

During impedance matching for the antenna of this embodiment, a desired impedance for the antenna of this invention may be achieved by increasing or decreasing the electromagnetic coupling between the first grounding element 2 and the first radiating element 4. The electromagnetic coupling between the first grounding element 2 and the first radiating element 4 may be increased or decreased by adjusting the dimensions of the second segment 42 of the first radiating element 4 or the gap 49 between the first segment 21 of the first grounding element 2 and the second segment 42 of the first radiating element 4.

Alternatively, the desired impedance for the antenna of this embodiment may be achieved by increasing or decreasing the electromagnetic coupling between the second grounding element 3 and the second radiating element 5. The electromagnetic coupling between the second grounding element 3 and the second radiating element 5 may be increased or decreased by adjusting the dimensions of the second radiating element 5 or the gap 59 between the first segment 31 of the second grounding element 3 and second segment of the second radiating element 5.

Moreover, the size of the slot 48, 58 in each of the first and second radiating elements 4, 5 or the length of each of the first and second grounding elements 2, 3 may be adjusted to achieve a desired resonance frequency for the antenna of this invention.

Further, when it is desired for the first frequency range to cover frequencies slightly higher than 3800 MHz, the first radiating element 4 may be lengthened such that the length thereof is longer than that of the first grounding element 2. Similarly, when it is desired for the second operating frequency to cover frequencies slightly lower than 3300 MHz, the first grounding element 2 may be lengthened such that the length thereof is longer than that of the first radiating element 4.

The first feeding point 7 is formed on the surface 10 of the dielectric substrate 1, is disposed between the first grounding element 2 and the connecting end 61 of the grounding plane 6, and is connected to the first end of the feeding segment 40 of the first radiating element 4.

The second feeding point 8 is formed on the surface 10 of the dielectric substrate 1, is disposed between the second grounding element 3 and the connecting end 61 of the grounding plane 6, and is connected to a feeding segment of the second radiating element 5.

Figure 3:
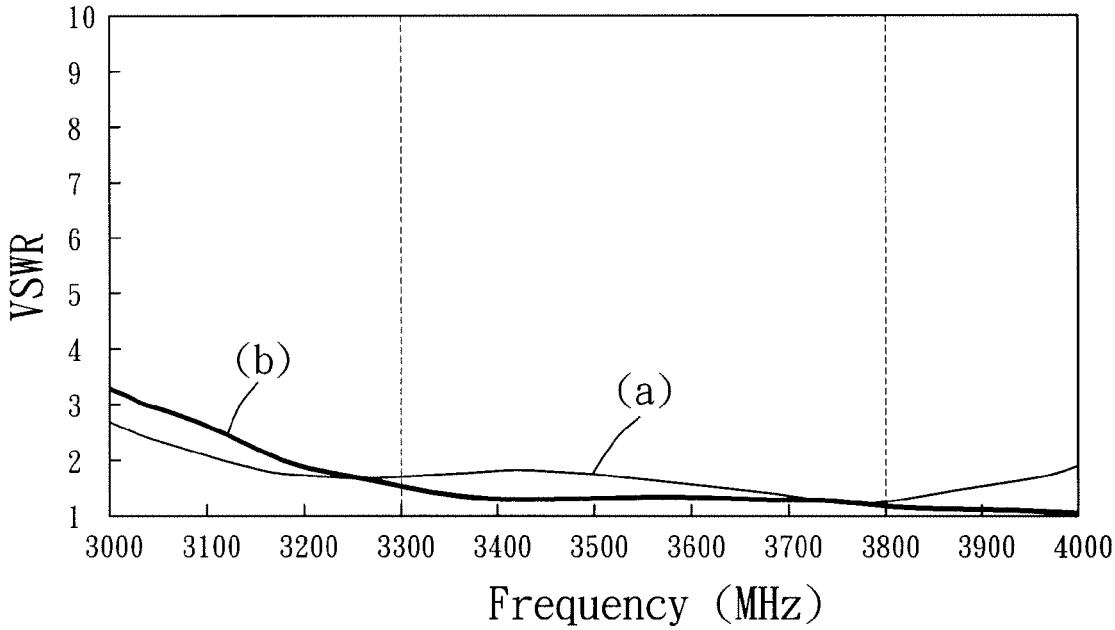
FIG. 3 is a plot illustrating a voltage standing wave ratio (VSWR) of each of first and second antenna units of the first preferred embodiment.
Figure 5:
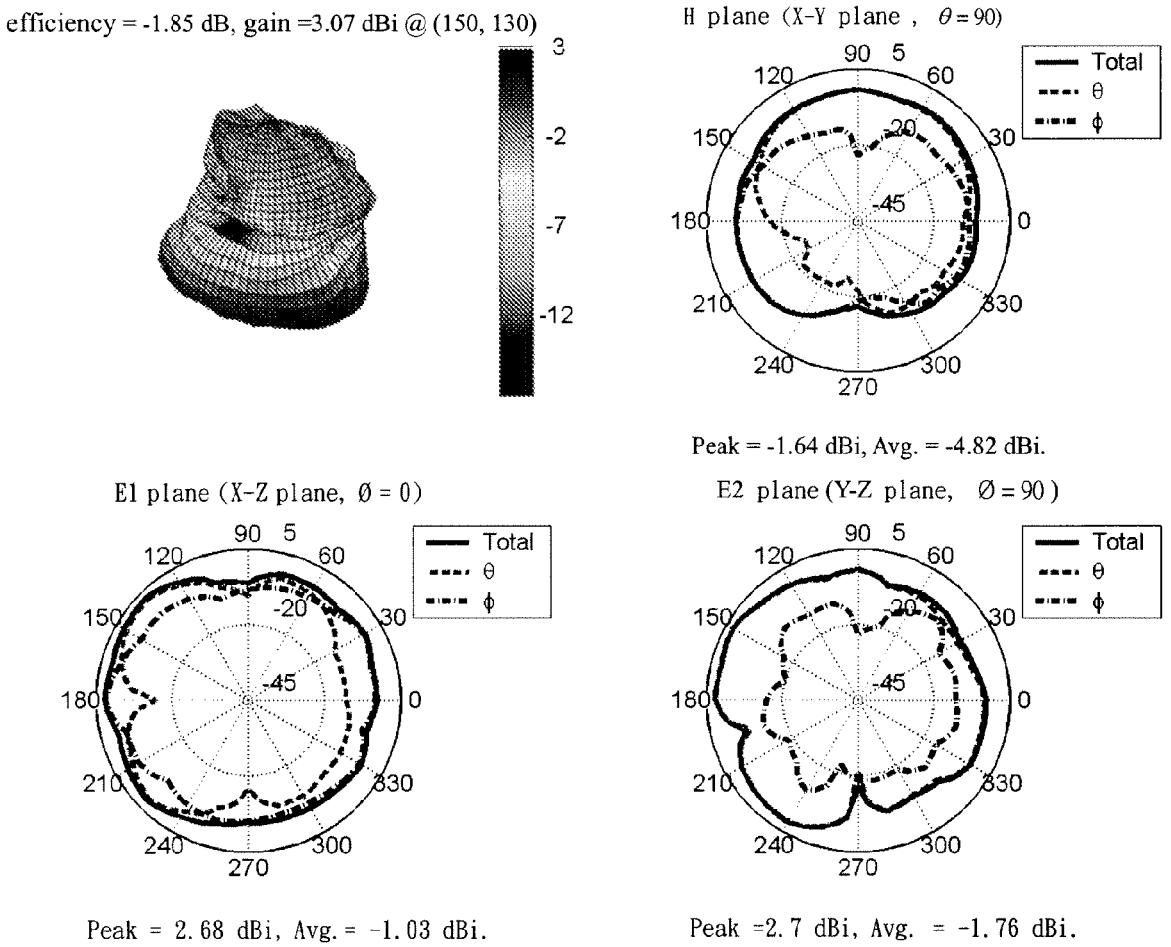
FIG. 5 shows plots of radiation patterns of the first antenna unit of the first preferred embodiment respectively on the x-y, x-z, and y-z planes when operated at 3300 MHz.
Figure 6:
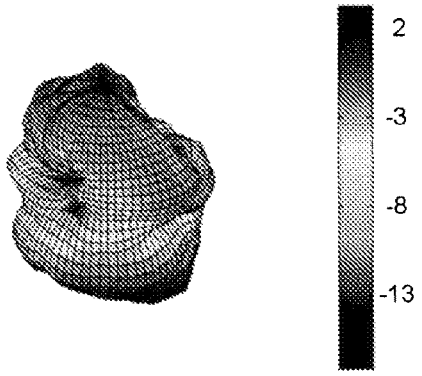
FIG. 6 shows plots of radiation patterns of the first antenna unit of the first preferred embodiment respectively on the x-y, x-z, and y-z planes when operated at 3500 MHz.
Figure 6:
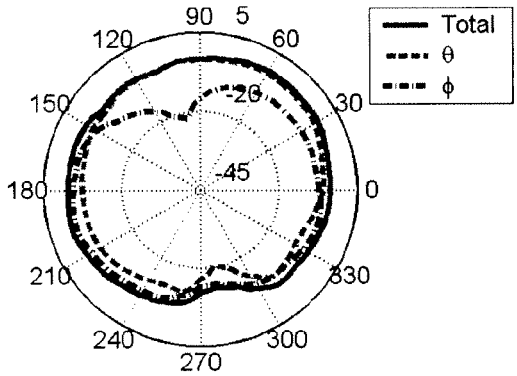
Figure 6:
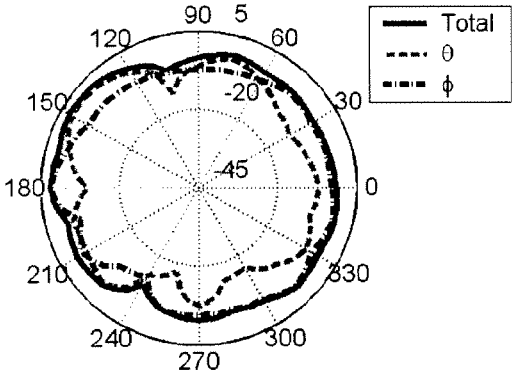
Figure 6:
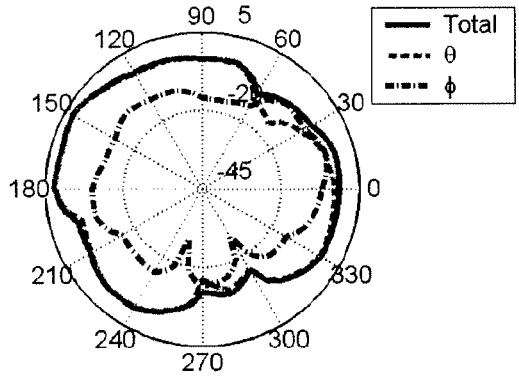
Figure 7:
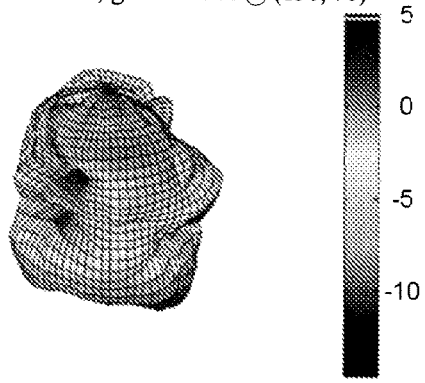
FIG. 7 shows plots of radiation patterns of the first antenna unit of the first preferred embodiment respectively on the x-y, x-z, and y-z planes when operated at 3700 MHz.
Figure 7:
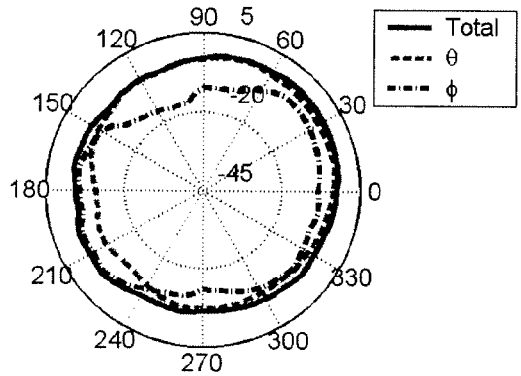
Figure 7:
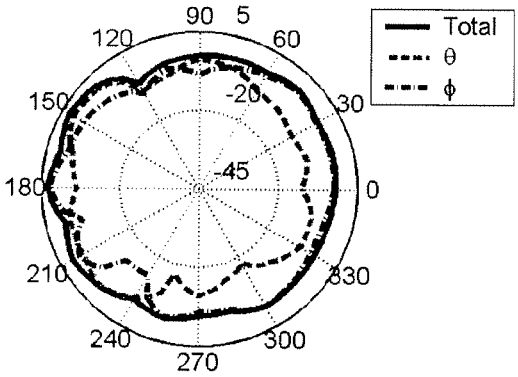
Figure 7:
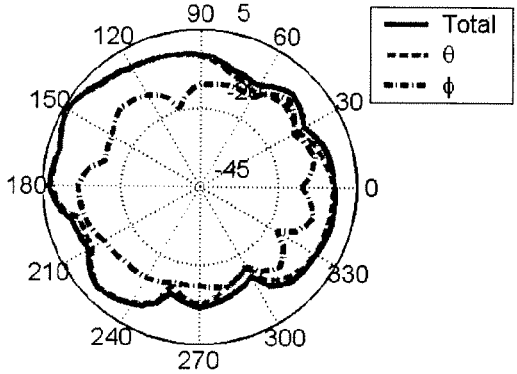
Figure 8:
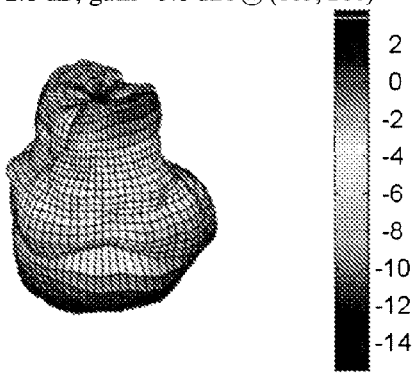
FIG. 8 shows plots of radiation patterns of the second antenna unit of the first preferred embodiment respectively on the x-y, x-z, and y-z planes when operated at 3300 MHz.
Figure 8:
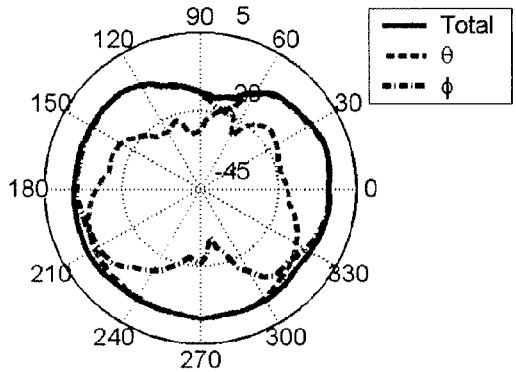
Figure 8:
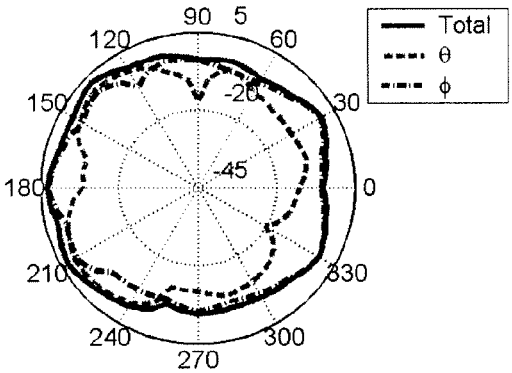
Figure 8:
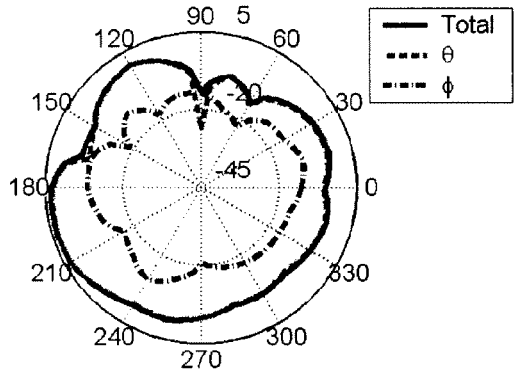
Figure 9:
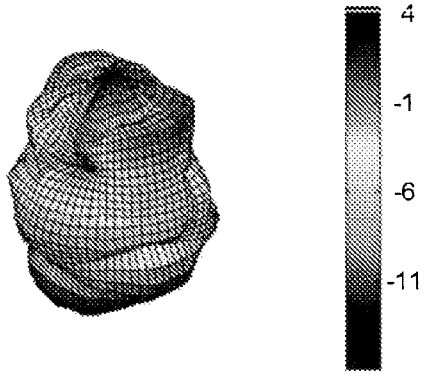
FIG. 9 shows plots of radiation patterns of the second antenna unit of the first preferred embodiment respectively on the x-y, x-z, and y-z planes when operated at 3500 MHz.
Figure 9:
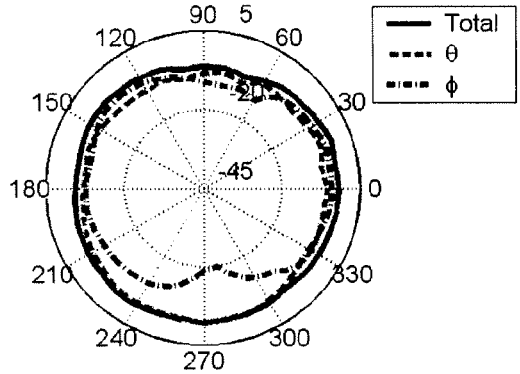
Figure 9:
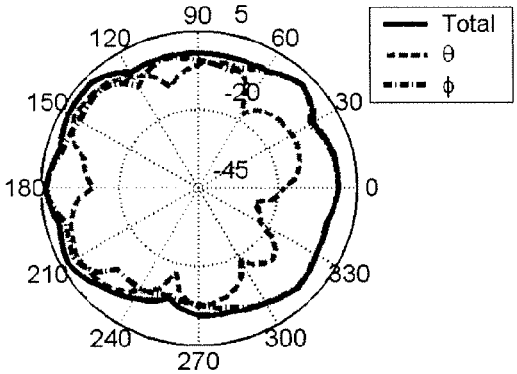
Figure 9:
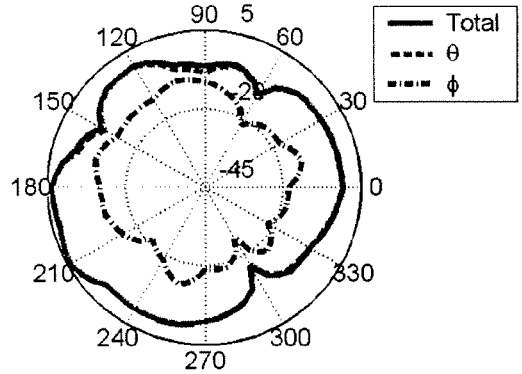
Figure 10:
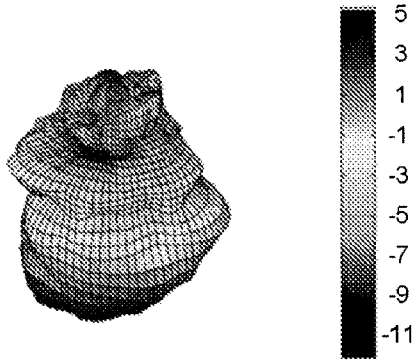
FIG. 10 shows plots of radiation patterns of the second antenna unit of the first preferred embodiment respectively on the x-y, x-z, and y-z planes when operated at 3700 MHz.
Figure 10:
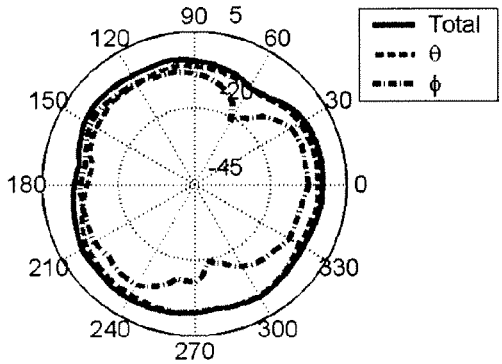
Figure 10:
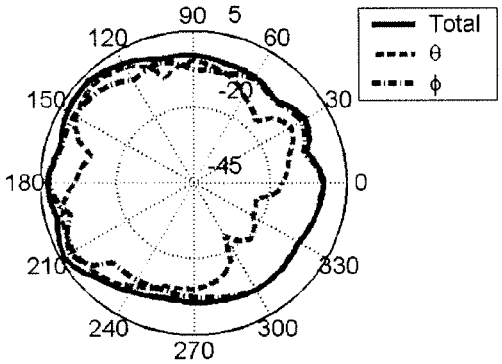
Figure 10:
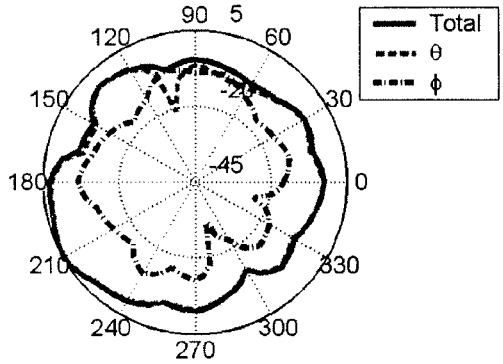

Experimental results, as illustrated in FIG. 3, show that each of the first antenna unit 100, as indicated by line (a), and the second antenna unit 200, as indicated by line (b), achieve a voltage standing wave ratio (VSWR) of less than 2.0 when operated in the first frequency range. Moreover, when operated in the first frequency range, as shown in Table I, the antenna of this embodiment has a minimum isolation of 18.6 dB, and as shown in Table II, the first antenna unit 100 has a maximum efficiency of −1.8 dB and a maximum peak gain of 5.0 dBi, and the second antenna unit 200 has a maximum efficiency of −1.7 dB and a maximum peak gain of 5.7 dBi. Further, the radiation patterns of the first antenna unit 100, as illustrated in FIGS. 5 to 7, complement the radiation patterns of the second antenna unit 200, as illustrated in FIGS. 8 to 10. It is therefore apparent that the antenna of this embodiment has a diversity effect that significantly reduces the susceptibility thereof to multipath interference, and thus, an increase in the efficiency thereof is achieved.

TABLE I

| | Frequency (MHz) | | | | | |
|---|---|---|---|---|---|---|
| | 3300 | 3400 | 3500 | 3600 | 3700 | 3800 |
| Isolation (dB) | 18.6 | 20.3 | 19.4 | 20.1 | 21.3 | 22.3 |

TABLE II

| | first antenna unit 100 | | second antenna unit 200 | |
|---|---|---|---|---|
| Frequency (MHz) | Efficiency (dB) | Peak gain (dBi) | Efficiency (dB) | Peak Gain (dBi) |
| 3300 | −1.8 | 3.1 | −2.1 | 3.8 |
| 3400 | −2.3 | 3.1 | −2.0 | 3.8 |
| 3500 | −2.6 | 3.2 | −1.8 | 4.4 |
| 3600 | −2.4 | 4.0 | −1.7 | 5.1 |
| 3700 | −2.1 | 5.0 | −1.8 | 5.7 |
| 3800 | −2.1 | 5.0 | −2.2 | 5.4 |

Figure 11:
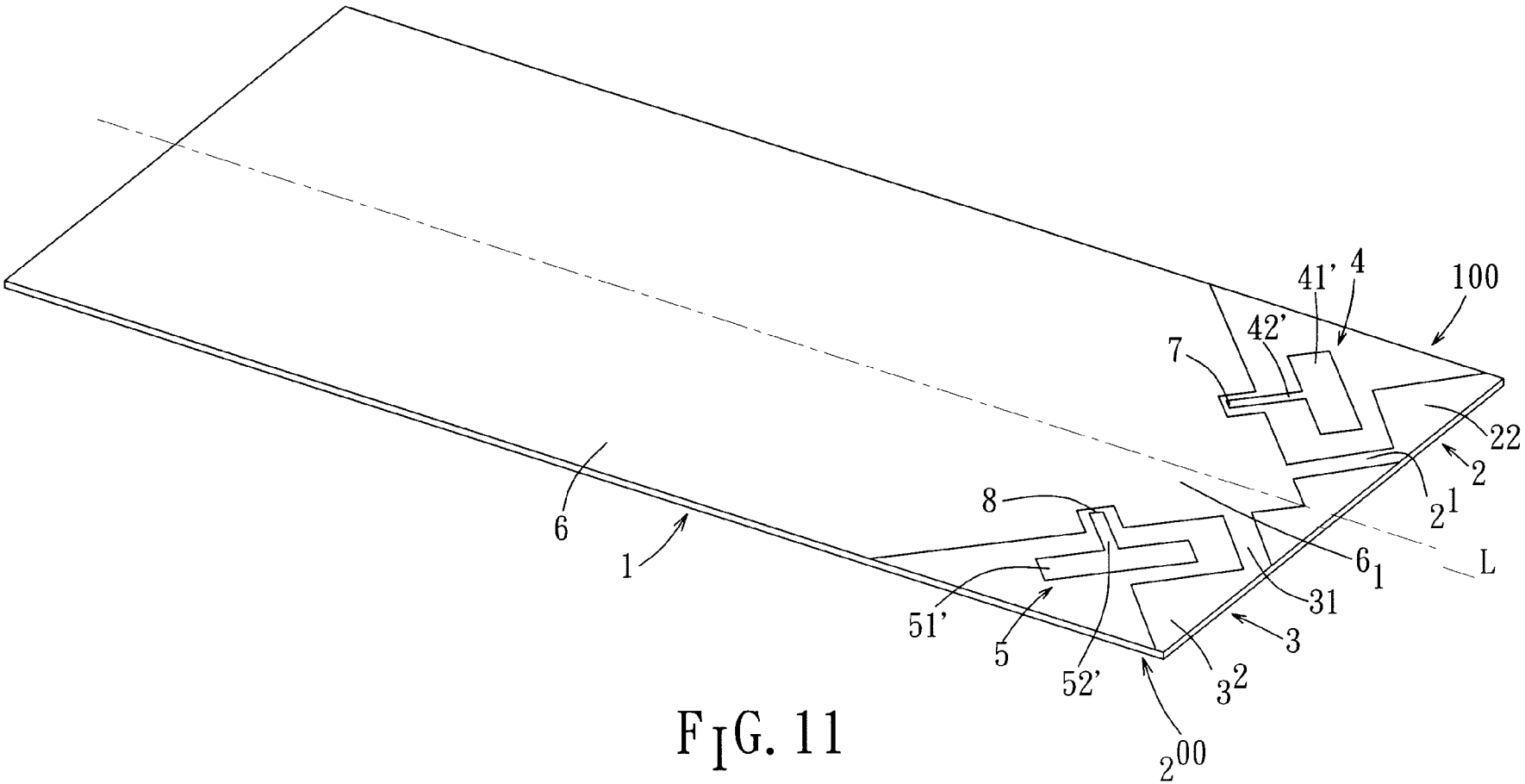
FIG. 11 is a perspective view of the second preferred embodiment of an antenna according to this invention.

FIG. 11 illustrates the second preferred embodiment of an antenna according to this invention.

The antenna of this embodiment is applicable to a card (not shown), such as a Personal Computer Memory Card International Association (PCMCIA card) or a wireless network card, and is operable in a second operating range from 2300 MHz to 3800 MHz.

Each of the first and second radiating elements 4, 5 is spaced apart from and coupled electromagnetically to a respective one of the first and second grounding elements 2, 3, thereby permitting operation of each of the first and second antenna units 100, 200 in the second frequency range, in manner that will be described hereinafter.

The first segments 21, 31 of the first and second grounding elements 2, 3 diverge from the connecting end 61 of the grounding plane 6, and the second segments 22, 32 of each of the first and second grounding elements 2, 3 has a generally triangular shape. The construction as such increases a bandwidth of the antenna of this embodiment.

The dimensions of the second segment 22, 32 of each of the first and second grounding elements 2, 3 may be adjusted to achieve a desired impedance bandwidth for the antenna of this embodiment.

Each of the first and second radiating elements 4, 5 is generally T-shape, has a first segment 41', 51' that is generally rectangular in shape and that has opposite ends, and a second segment 42', 52' that is generally rectangular in shape and that is connected to the first segment 41', 51' thereof at a position between the ends of the first segment 41', 51' thereof.

In this embodiment, each of the first and second grounding elements 2, 3 operates in the 2300 MHz to 2700 MHz range, while each of the first and second radiating elements 4, 5 operates in the 3300 MHz to 3800 MHz range.

In an alternative embodiment, each of the first and second grounding elements 2, 3 operates in the 3300 MHz to 3800 MHz range, while each of the first and second radiating elements 4, 5 operates in the 2300 MHz to 2700 MHz range.

In this embodiment, each of the first and second grounding elements 2, 3 has a length of one-quarter wavelength in the 2300 MHz to 2700 MHz range. Moreover, in this embodiment, each of the first and second radiating elements 4, 5 has a length of one-quarter wavelength in the 3300 MHz to 3800 MHz.

The second segment 42', 52' of each of the first and second radiating elements 4, 5 has a distal end distal from the first segment, 41', 51' of the respective one of the first and second radiating elements 4, 5.

Each of the first and second feeding points 7, 8 is connected to the distal end of the second segment 42', 52' of a respective one of the first and second radiating elements 4, 5.

Figure 12:
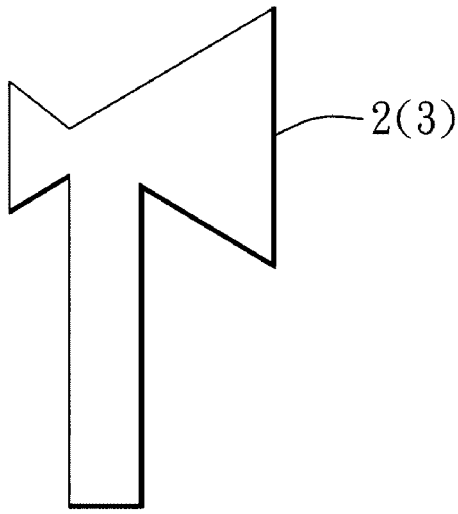
FIGS. 12 to 16 are schematic views of modified embodiments of the second preferred embodiment according to this invention.
Figure 13:
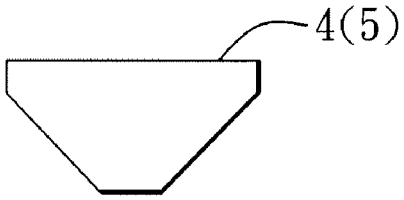
Figure 14:
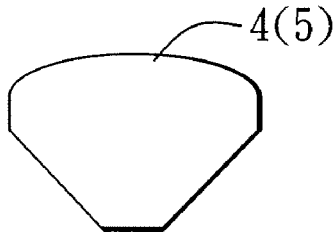
Figure 15:
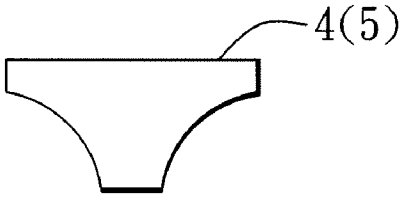
Figure 16:
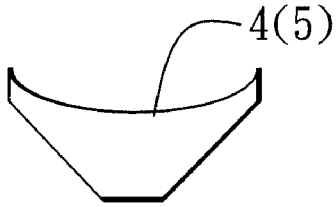

FIG. 12 illustrates a modified embodiment of the second preferred embodiment according to this invention. In this embodiment, each of the first and second grounding elements 2, 3 is formed approximately in the shape of an axe. Moreover, in this embodiment, as illustrated in FIGS. 13 to 16, each of the first and second radiating elements 4, 5 is an irregular hexagonal shape.

Figure 17:
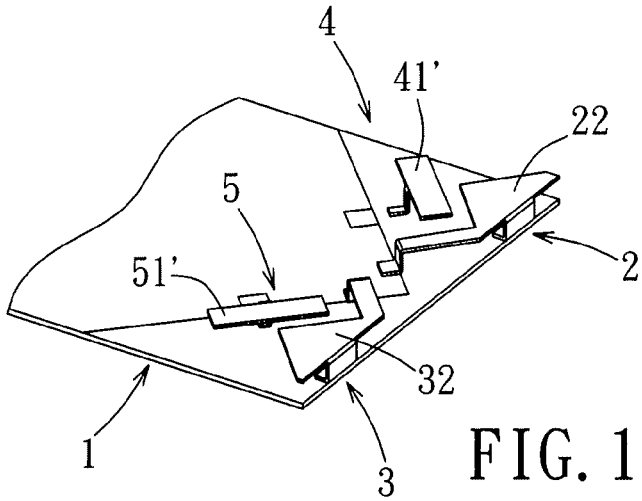
FIGS. 17 to 19 are perspective views of modified embodiments of the second preferred embodiment according to this invention.

FIG. 17 illustrates another modified embodiment of the second preferred embodiment according to this invention. In this embodiment, the second segment 22, 32 of each of the first and second grounding elements 2, 3 is spaced apart from the dielectric substrate 1. Moreover, in this embodiment, the first segment 41', 51' of each of the first and second radiating elements 4, 5 is spaced apart from the dielectric substrate 1.

Figure 18:
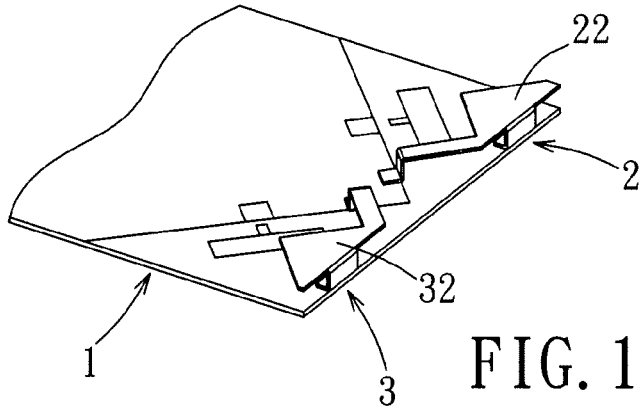

FIG. 18 illustrates yet another modified embodiment of the second preferred embodiment according to this invention. In this embodiment, only the second segment 22, 32 of each of the first and second grounding elements 2, 3 is spaced apart from the dielectric substrate 1.

Figure 19:
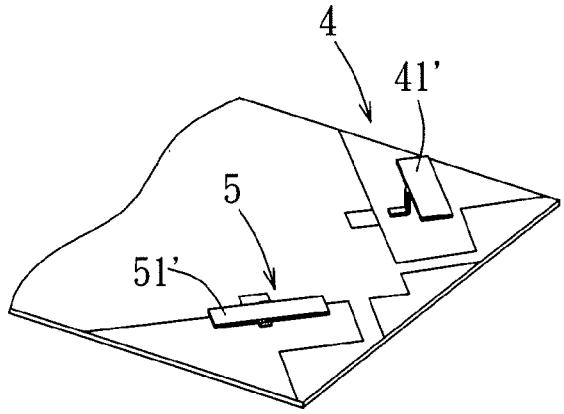

FIG. 19 illustrates still yet another modified embodiment of the second preferred embodiment according to this invention. In this embodiment, only the first segment 41', 51' of each of the first and second radiating elements 4, 5 is spaced apart from the dielectric substrate 1.

Figure 20:
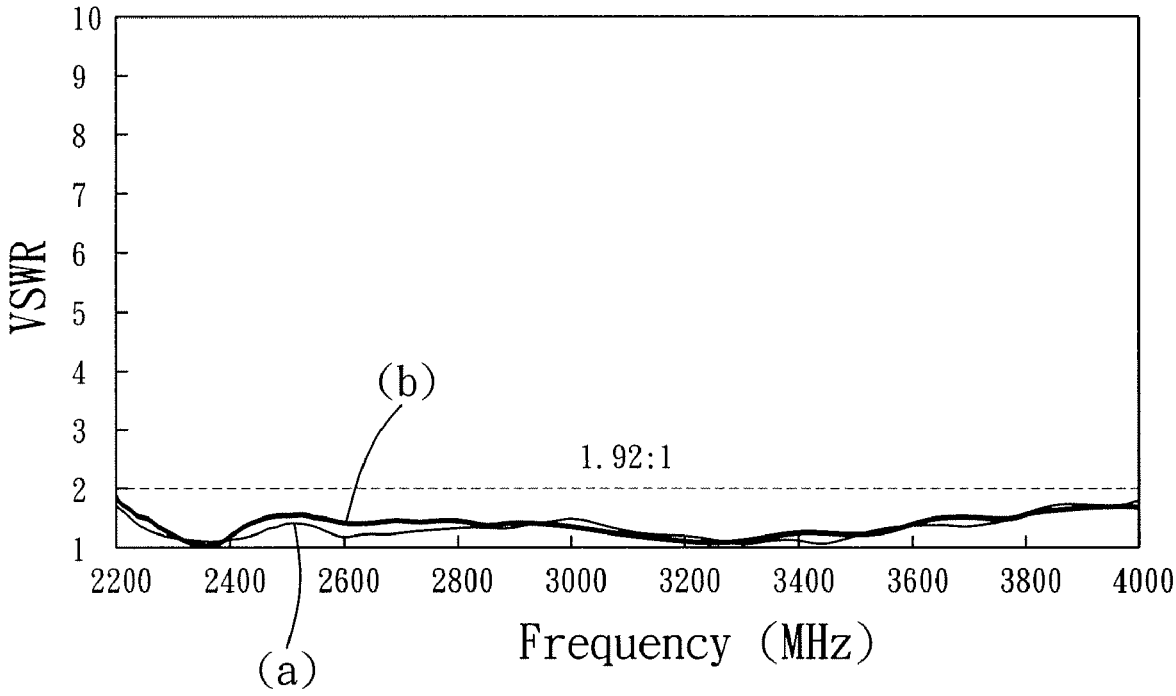
FIG. 20 is a plot illustrating a voltage standing wave ratio (VSWR) of each of first and second antenna units of the second preferred embodiment.
Figure 21:
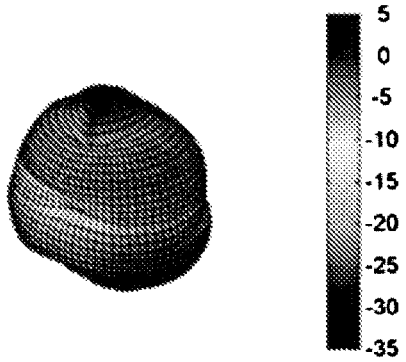
FIG. 21 shows plots of radiation patterns of the second preferred embodiment when operated at 2500 MHz.
Figure 21:
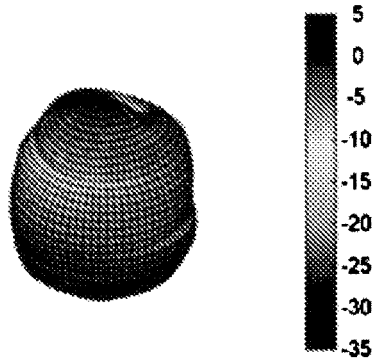
Figure 21:
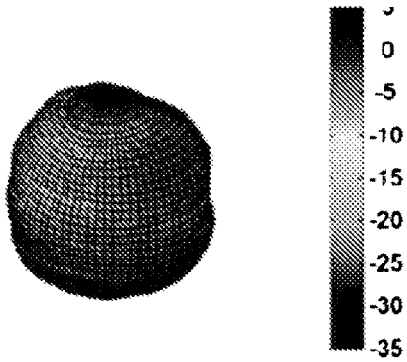
Figure 21:
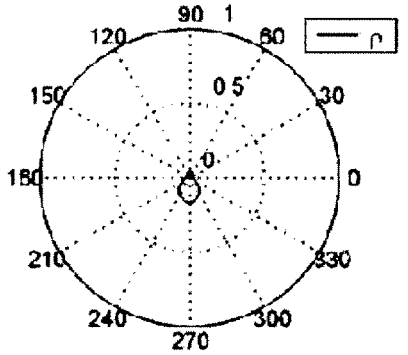
Figure 22:
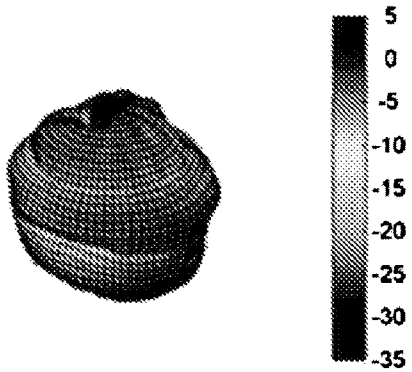
FIG. 22 shows plots of radiation patterns of the second preferred embodiment when operated at 3500 MHz.
Figure 22:
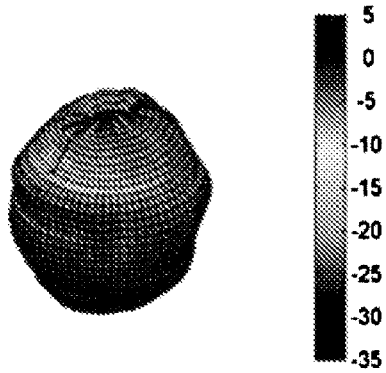
Figure 22:
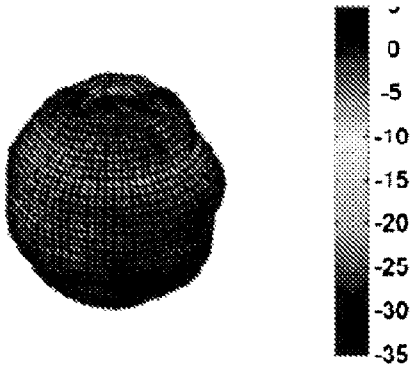
Figure 22:
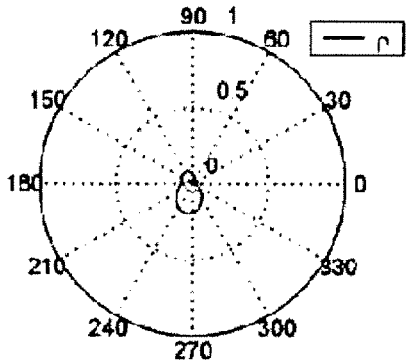

Experimental results, as illustrated in FIG. 20, show that each of the first antenna unit 100, as indicated by line (a), and the second antenna unit 200, as indicated by line (b), achieves a voltage standing wave ratio (VSWR) of less than 2.0 when operated in the second frequency range. Moreover, when operated in the second frequency range, the antenna of this embodiment achieves a minimum isolation of 18.7 dB, as shown in Table III, and a minimum envelop correlation coefficient (ECC) of 0.01, as shown in Table IV. Further, when operated in the second frequency range, the first antenna unit 100 achieves a maximum efficiency of −0.7 dB and a maximum peak gain of 6.5 dBi, as shown in Table V, and the second antenna unit 200 achieves a maximum efficiency of −0.6 dB and a maximum peak gain of 6.7 dBi. In addition, it is evident from FIGS. 21 and 22 that the relationship between the first and second antenna units 100, 200 is small.

TABLE III

| | Frequency (MHz) | | | | | |
|---|---|---|---|---|---|---|
| | 2300 | 2500 | 2700 | 3300 | 3500 | 3800 |
| Isolation (dB) | 19.8 | 23.2 | 18.7 | 21.6 | 23.6 | 19.6 |

TABLE IV

| | Frequency (MHz) | | | | | |
|---|---|---|---|---|---|---|
| | 2300 | 2500 | 2700 | 3300 | 3500 | 3800 |
| ECC | 0.05 | 0.06 | 0.10 | 0.06 | 0.05 | 0.01 |

TABLE V

| | first antenna unit 100 | | second antenna unit 200 | |
|---|---|---|---|---|
| Frequency (MHz) | Efficiency (dB) | Peak gain (dBi) | Efficiency (dB) | Peak Gain (dBi) |
| 2300 | −0.7 | 6.5 | −0.6 | 6.4 |
| 2400 | −0.8 | 6.0 | −0.8 | 6.1 |
| 2500 | −1.2 | 5.2 | −1.3 | 5.3 |
| 2600 | −0.8 | 5.5 | −0.7 | 5.9 |
| 2700 | −1.0 | 5.3 | −1.0 | 5.4 |
| 3300 | −0.8 | 5.4 | −0.9 | 5.8 |
| 3400 | −1.2 | 5.0 | −1.1 | 6.1 |
| 3500 | −1.4 | 5.1 | −1.1 | 6.1 |
| 3600 | −1.4 | 5.1 | −1.2 | 6.3 |
| 3700 | −1.1 | 6.0 | −0.9 | 6.7 |
| 3800 | −1.1 | 6.0 | −1.0 | 6.3 |

Figure 23:
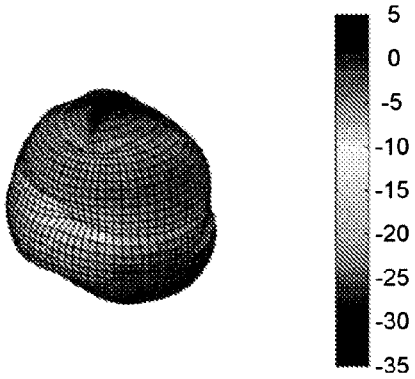
FIG. 23 shows plots of radiation patterns of the first antenna unit of the second preferred embodiment respectively on the x-y, x-z, and y-z planes when operated at 2500 MHz.
Figure 23:
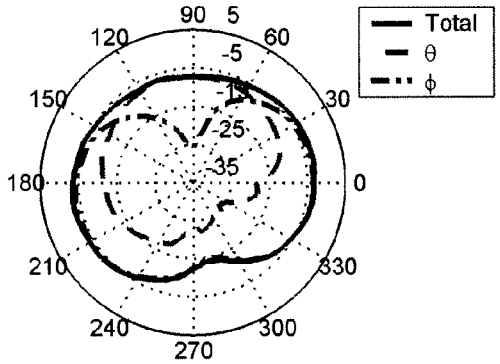
Figure 23:
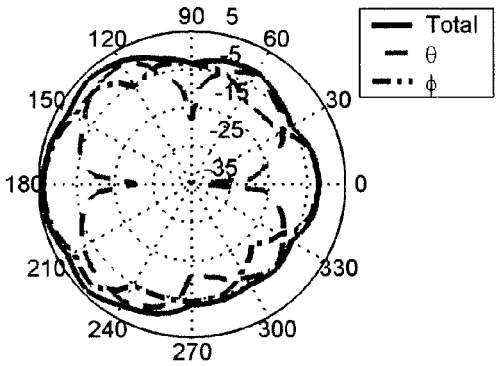
Figure 23:
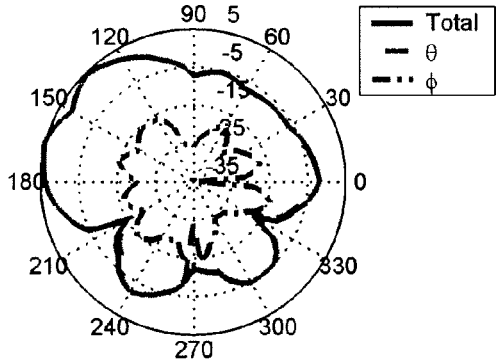
Figure 24:
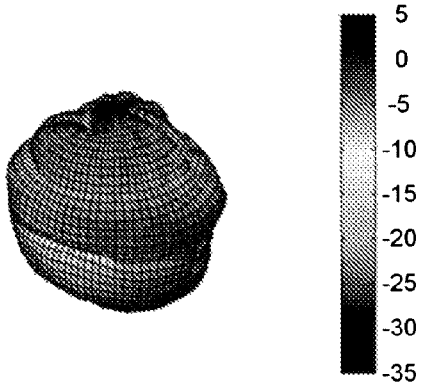
FIG. 24 shows plots of radiation patterns of the first antenna unit of the second preferred embodiment respectively on the x-y, x-z, and y-z planes when operated at 3500 MHz.
Figure 24:
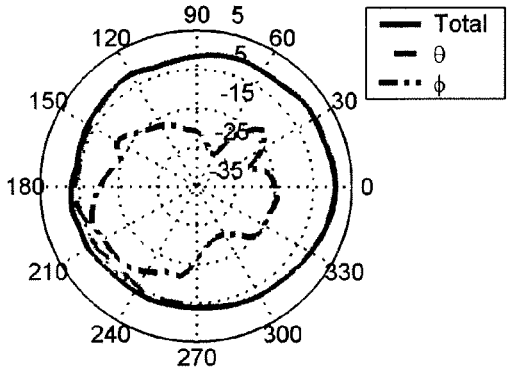
Figure 24:
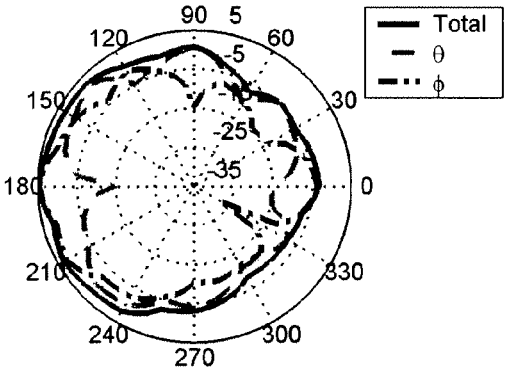
Figure 24:
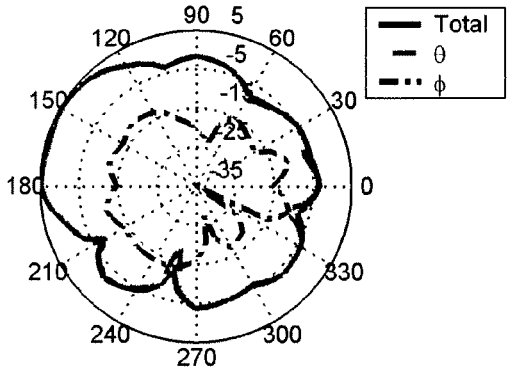
Figure 25:
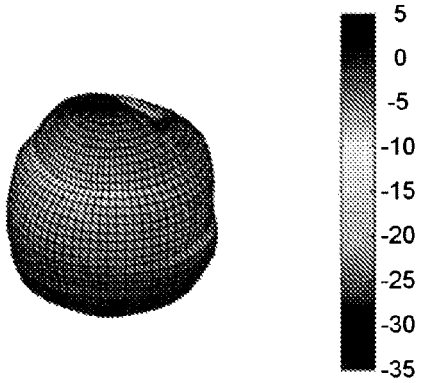
FIG. 25 shows plots of radiation patterns of the second antenna unit of the second preferred embodiment respectively on the x-y, x-z, and y-z planes when operated at 2500 MHz.
Figure 25:
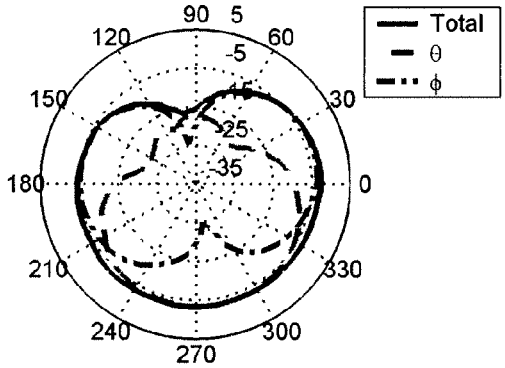
Figure 25:
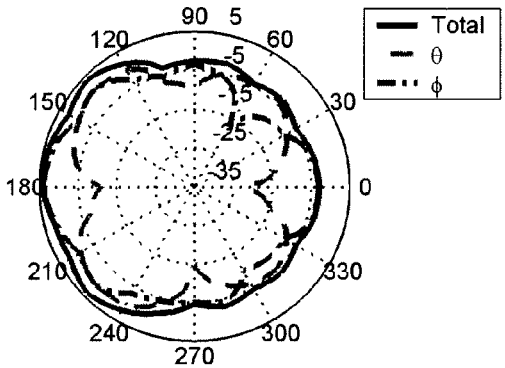
Figure 25:
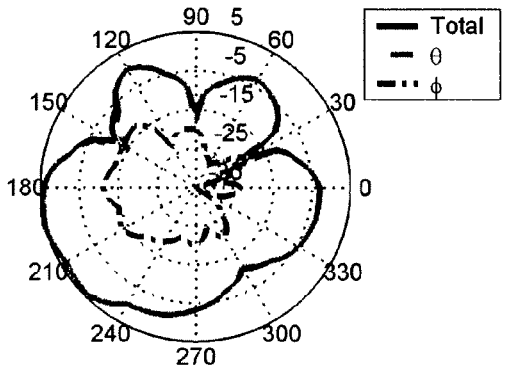
Figure 26:
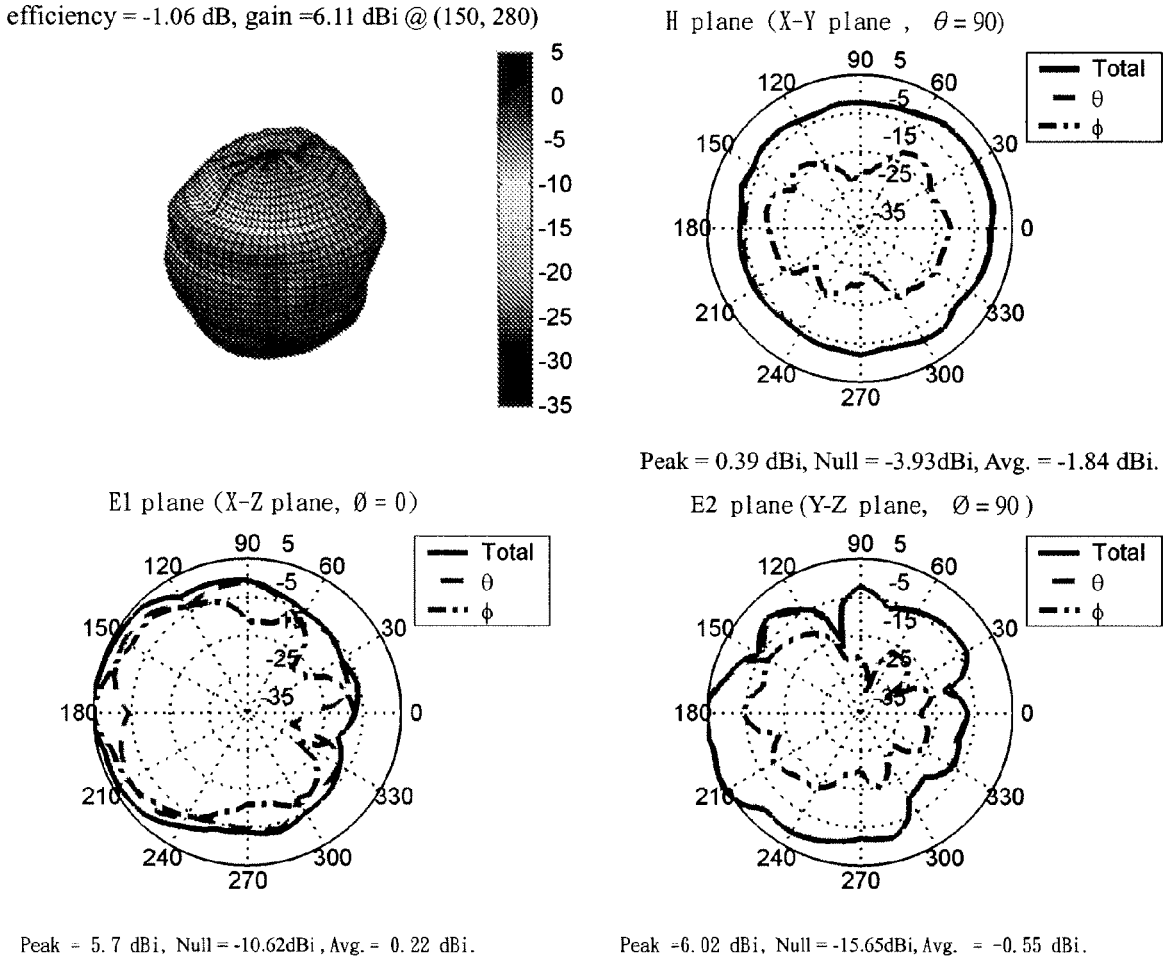
FIG. 26 shows plots of radiation patterns of the second antenna unit of the second preferred embodiment respectively on the x-y, x-z, and y-z planes when operated at 3500 MHz.

Furthermore, the radiation patterns of the first antenna unit 100, as illustrated in FIGS. 23 and 24, complement the radiation patterns of the second antenna unit 200, as illustrated in FIGS. 25 and 26. It is therefore apparent that the antenna of this embodiment has a diversity effect that significantly reduces the susceptibility thereof to multipath interference, and thus, an increase in the efficiency thereof is achieved.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna comprising:

a dielectric substrate;

a grounding plane formed on said dielectric substrate and having a connecting end;

first and second grounding elements extending from said connecting end of said grounding plane away from each other;

spaced apart first and second radiating elements between which said connecting end of said grounding plane is disposed, said first radiating element being spaced apart from and coupled electromagnetically to said first grounding element, thereby permitting operation of said first grounding element and said first radiating element in a frequency range, said second radiating element being spaced apart from and coupled electromagnetically to said second grounding element, thereby permitting operation of said second grounding element and said second radiating element in the frequency range; and first and second feeding points, each of which is formed on said dielectric substrate and is coupled to a respective one of said first and second radiating elements.

2. The antenna as claimed in claim 1, wherein said connecting end of said grounding plane is tapered and has a tip, said first and second grounding elements extending from said tip of said connecting end of said grounding plane.

3. The antenna as claimed in claim 1, wherein said first radiating element is disposed between said connecting end of said grounding plane and said first grounding element, and said second radiating element is disposed between said connecting end of said grounding plane and said second grounding element.

4. The antenna as claimed in claim 1, wherein each of said first and second radiating elements defines a slot therein.

5. The antenna as claimed in claim 4, wherein said slot in said second radiating element is smaller than said slot in said first radiating element.

6. The antenna as claimed in claim 4, wherein said first radiating element includes a feeding segment to which said first feeding point is coupled, a first segment that extends from said feeding segment thereof, a second segment that extends from said first segment thereof, and a third segment that extends from said second segment thereof, said slot in said first radiating element being defined by said first, second, and third segments of said first radiating element.

7. The antenna as claimed in claim 6, wherein said second segment of said first radiating element has a length of less than one-eighth wavelength in the frequency range.

8. The antenna as claimed in claim 6, wherein said first grounding element includes a first segment that extends from said connecting end of said grounding plane, said second segment of said first radiating element being disposed adjacent and substantially parallel to said first segment of said first grounding element, and a second segment that extends transversely from said first segment thereof.

9. The antenna as claimed in claim 1, wherein said second grounding element has a length shorter than that of said first grounding element.

10. The antenna as claimed in claim 1, wherein at least one of said first grounding element and said first radiating element has a length of one-quarter wavelength in the frequency range.

11. The antenna as claimed in claim 1, wherein said first grounding element includes a first segment that extends from said connecting end of said grounding plane, and a second segment that extends from said first segment thereof and that has a generally triangular shape.

12. The antenna as claimed in claim 1, wherein said first grounding element is generally axe-shaped.

13. The antenna as claimed in claim 1, wherein said first radiating element is one of a T-shape and an irregular hexagonal shape.

14. The antenna as claimed in claim 1, wherein said first and second radiating elements are partially symmetrical.

15. The antenna as claimed in claim 1, wherein said first and second grounding elements are partially symmetrical.

16. The antenna as claimed in claim 1, wherein at least one of said first grounding element and said first radiating element has a segment that is spaced apart from said dielectric substrate.

17. The antenna as claimed in claim 1, wherein the frequency range covers frequencies from 3300 MHz to 3800 MHz.

18. The antenna as claimed in claim 1, wherein the frequency range covers frequencies from 2300 MHz to 3800 MHz.

19. The antenna as claimed in claim 1, wherein said first radiating element operates in one of a 2300 MHz to 2700 MHz range and a 3300 MHz to 3800 MHz range.

20. The antenna as claimed in claim 1, wherein said first grounding element operates in one of a 2300 MHz to 2700 MHz range and a 3300 MHz to 3800 MHz range.

* * * * *